US008938926B2

(12) United States Patent
Sareyka et al.

(10) Patent No.: US 8,938,926 B2
(45) Date of Patent: Jan. 27, 2015

(54) WALL LINER

(75) Inventors: Brett W. Sareyka, Aston, PA (US); William J. Platt, Aston, PA (US)

(73) Assignee: Worthington Armstrong Venture, Malvern, PA (US)

( * ) Notice: Subject to any disclaimer, the term of this patent is extended or adjusted under 35 U.S.C. 154(b) by 1560 days.

(21) Appl. No.: 11/985,690

(22) Filed: Nov. 15, 2007

(65) Prior Publication Data

US 2009/0126304 A1 May 21, 2009

(51) Int. Cl.

| | |
|---|---|
| ***E04B 2/30*** | (2006.01) |
| ***E04C 2/34*** | (2006.01) |
| ***E04C 2/38*** | (2006.01) |
| ***E04B 2/00*** | (2006.01) |
| ***E04H 1/00*** | (2006.01) |
| ***E04F 13/08*** | (2006.01) |
| ***E04B 2/74*** | (2006.01) |
| ***E04B 9/06*** | (2006.01) |
| ***E04B 9/18*** | (2006.01) |

(52) U.S. Cl.

CPC ..... *E04B 2/7453* (2013.01); *E04B 9/067* (2013.01); *E04B 9/18* (2013.01); *E04F 13/0805* (2013.01)

USPC ..... 52/483.1; 52/506.06; 52/506.07; 52/508; 52/481.1; 52/475.1; 52/489.1; 52/241; 52/235; 52/384; 52/385

(58) Field of Classification Search

USPC ..... 52/506.06, 506.07, 508, 481.1, 481.2, 52/241, 235, 745.09, 745.1, 391, 384, 385, 52/475.1, 489.1

See application file for complete search history.

(56) References Cited

U.S. PATENT DOCUMENTS

| | | | | |
|---|---|---|---|---|
| 1,814,202 | A * | 7/1931 | Winget | 403/274 |
| 2,109,520 | A * | 3/1938 | Awbrey | 52/378 |
| 3,845,601 | A * | 11/1974 | Kostecky | 52/290 |
| 3,921,346 | A | 11/1975 | Sauer et al. | |
| 3,948,011 | A * | 4/1976 | Price et al. | 52/241 |
| 4,719,730 | A * | 1/1988 | Winkowski | 52/238.1 |
| 4,757,663 | A | 7/1988 | Kuhr | |
| 5,953,876 | A * | 9/1999 | Agar | 52/489.1 |
| 5,979,055 | A | 11/1999 | Sauer et al. | |
| 6,047,512 | A * | 4/2000 | Wendt et al. | 52/506.07 |
| 6,401,417 | B1 * | 6/2002 | Leblang | 52/481.1 |
| 6,722,098 | B2 | 4/2004 | Platt | |
| 6,983,569 | B1 * | 1/2006 | Rosenberg | 52/241 |
| 7,207,148 | B2 | 4/2007 | Surowiecki | |
| 2002/0046525 | A1 * | 4/2002 | Rice | 52/481.1 |
| 2006/0191236 | A1 * | 8/2006 | Surowiecki | 52/733.3 |

FOREIGN PATENT DOCUMENTS

| | | | |
|---|---|---|---|
| DE | 91 14 137 | U1 | 4/1992 |
| DE | 20 2004 021 147 | U1 | 1/2007 |
| EP | 1 617 005 | A2 | 1/2006 |
| GB | 2 109 834 | A | 6/1983 |
| GB | 2 284 219 | A | 5/1995 |
| WO | WO 2007/064307 | A1 | 6/2007 |

* cited by examiner

*Primary Examiner* — Brian Glessner
*Assistant Examiner* — Omar Hijaz
(74) *Attorney, Agent, or Firm* — Stradley Ronon Stevens & Young, LLP

(57) ABSTRACT

Prior art rolled T-beams used in horizontal grids in suspended ceilings, serve as vertical studs in a grid that supports wallboard in a liner for a structural wall. A horizontal strut extends along, and is connected to, the studs, to unite the studs and the strut to form the vertical grid. The grid is braced from the structural wall.

5 Claims, 5 Drawing Sheets

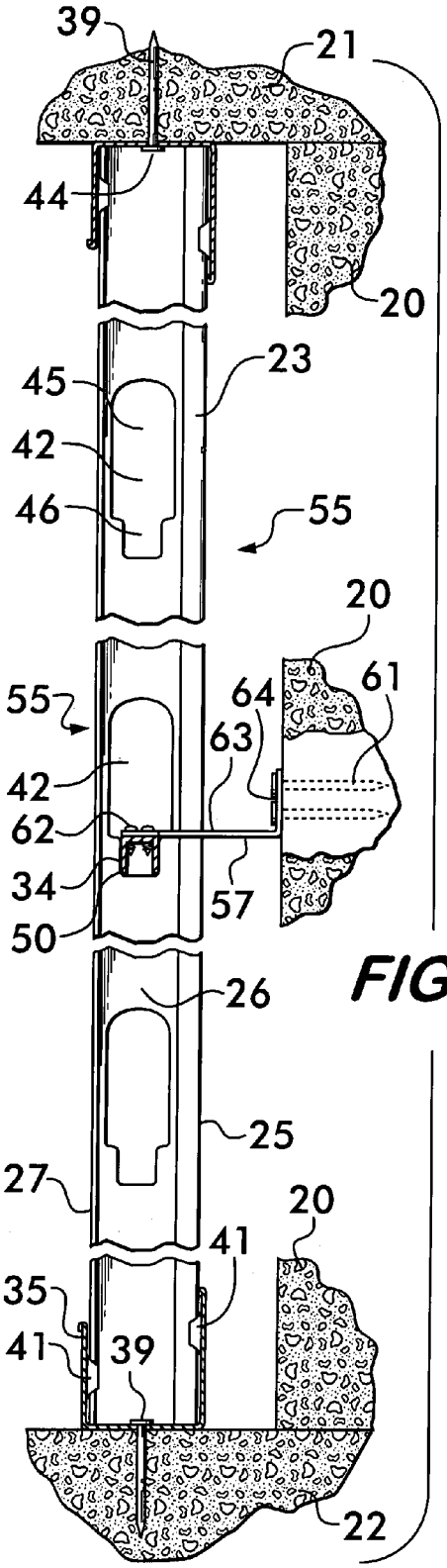
FIG.2
FIG.4
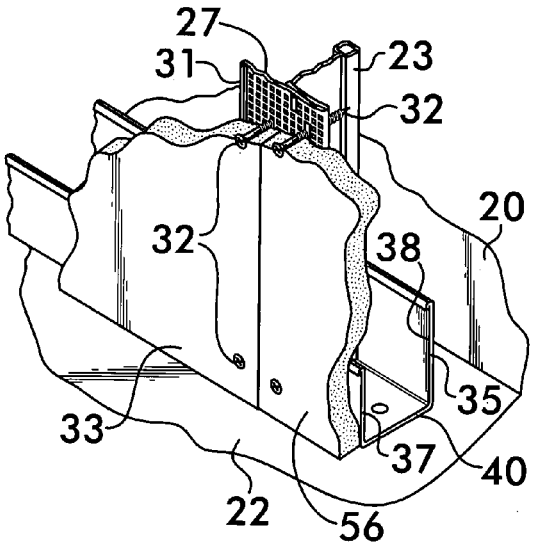
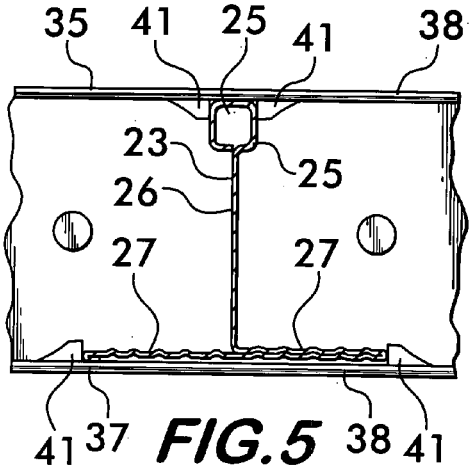
FIG.5

WALL LINER

BACKGROUND OF THE INVENTION

Suspended, horizontally extending, drywall ceilings are well known. Such ceilings have wallboard sheets attached by self-tapping screws to rolled T-beams that are suspended from a structural ceiling by hang wires. The T-beams in a horizontal drywall suspended ceiling are united into a horizontal grid of main beams and cross beams, to provide stability. Such a prior art T-beam used in a horizontal suspended drywall ceiling grid is disclosed in U.S. Pat. No. 6,722,098 for Beam for Drywall Ceiling, incorporated herein by reference.

Such a suspended drywall ceiling could be considered a ceiling liner for a structural ceiling.

The prior art T-beams used in such drywall suspended ceilings are continuously formed by passing a web of sheet metal through a series of rollforming stations, as disclosed, for instance, in U.S. Pat. No. 5,979,055, for Process for Producing Rollformed Sections, incorporated herein as reference.

Such T-beams have a cross section of an inverted T shape, with a bulb at the top, a web depending downward from the bulb, and opposing flanges, extending horizontally from the web at the bottom thereof, as seen in the '098 patent. The beam design lends itself to ready insertion of the self-tapping screws into the flanges of the beams.

Such a T-beam used in a horizontal suspended ceiling is primarily subjected to a load downward from the weight of the ceiling.

BRIEF SUMMARY OF THE INVENTION

The present invention uses the above-described T-beams of the prior art as vertical studs in a vertically extending grid that supports wallboard in a wall liner. Even though such T-beams are designed to be used horizontally to withstand a downward load, the present invention enables a stud to act as a column subject to buckling and twisting. The T-beam studs are united, and the strength of the studs combined, into the vertically extending grid by a horizontal strut that extends through, and is attached to, the vertical studs. The grid is braced from, for instance, a structural or partition wall. Drywall sheets are attached to the studs by self-tapping screws, as in prior art suspended ceilings.

BRIEF DESCRIPTION OF THE SEVERAL VIEWS OF THE DRAWING

FIG. 2 is a sectional view taken on the line 2-2 in FIG. 1.

FIG. 4 is a partial perspective view, with elements broken away, to show drywall attached to a rolled T-beam, acting as a stud, and to a bottom track.

FIG. 5 is a sectional view taken on the line 5-5 of FIG. 1, showing a T-beam supported in a bottom track.

DETAILED DESCRIPTION OF THE INVENTION

Figure 1:
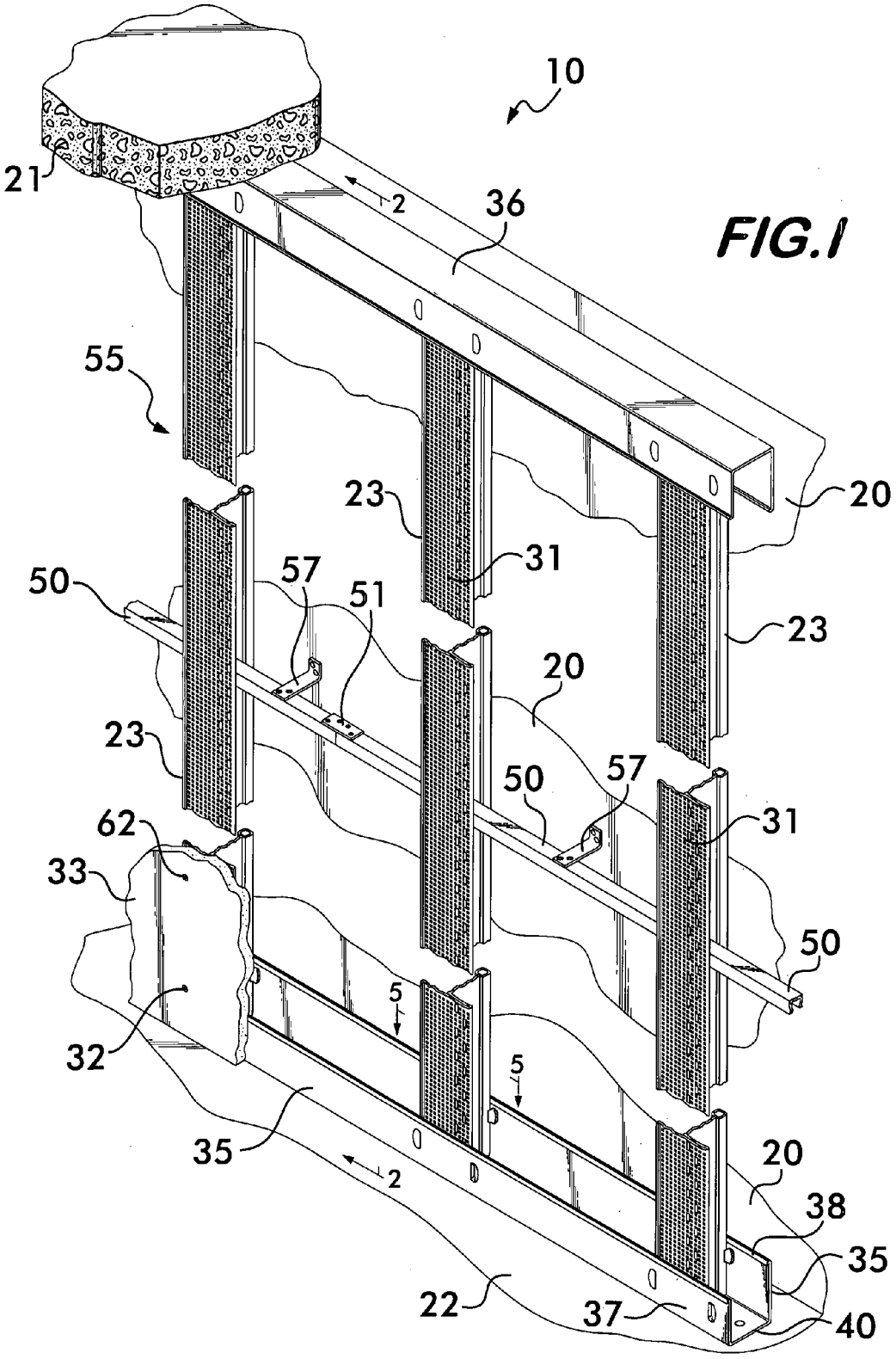
FIG. 1 is a perspective view of the invention with elements broken away.
Figure 3:
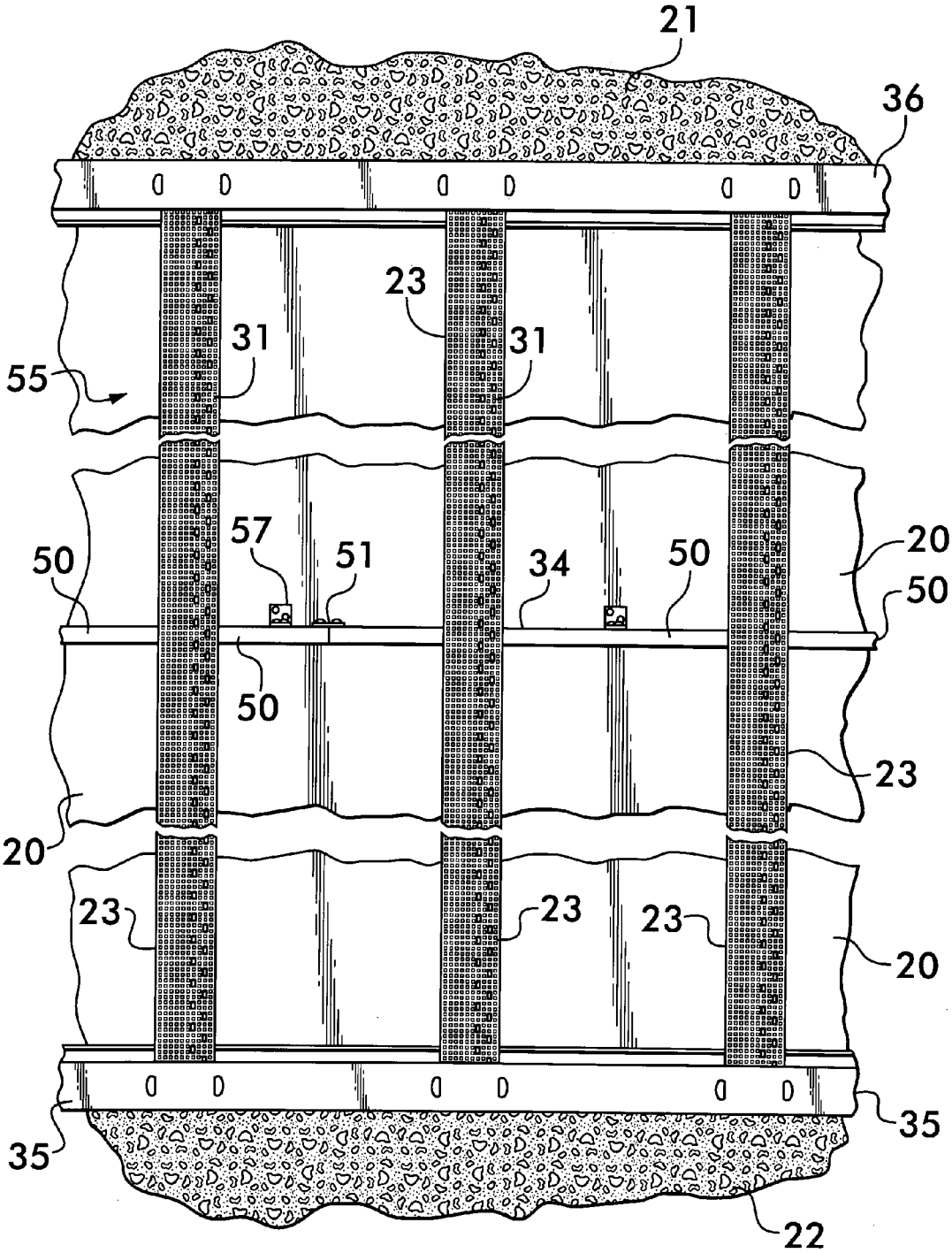
FIG. 3 is a front plan view of the invention before the drywall sheets are attached to the rolled T-beam, acting as a stud.
Figure 6:
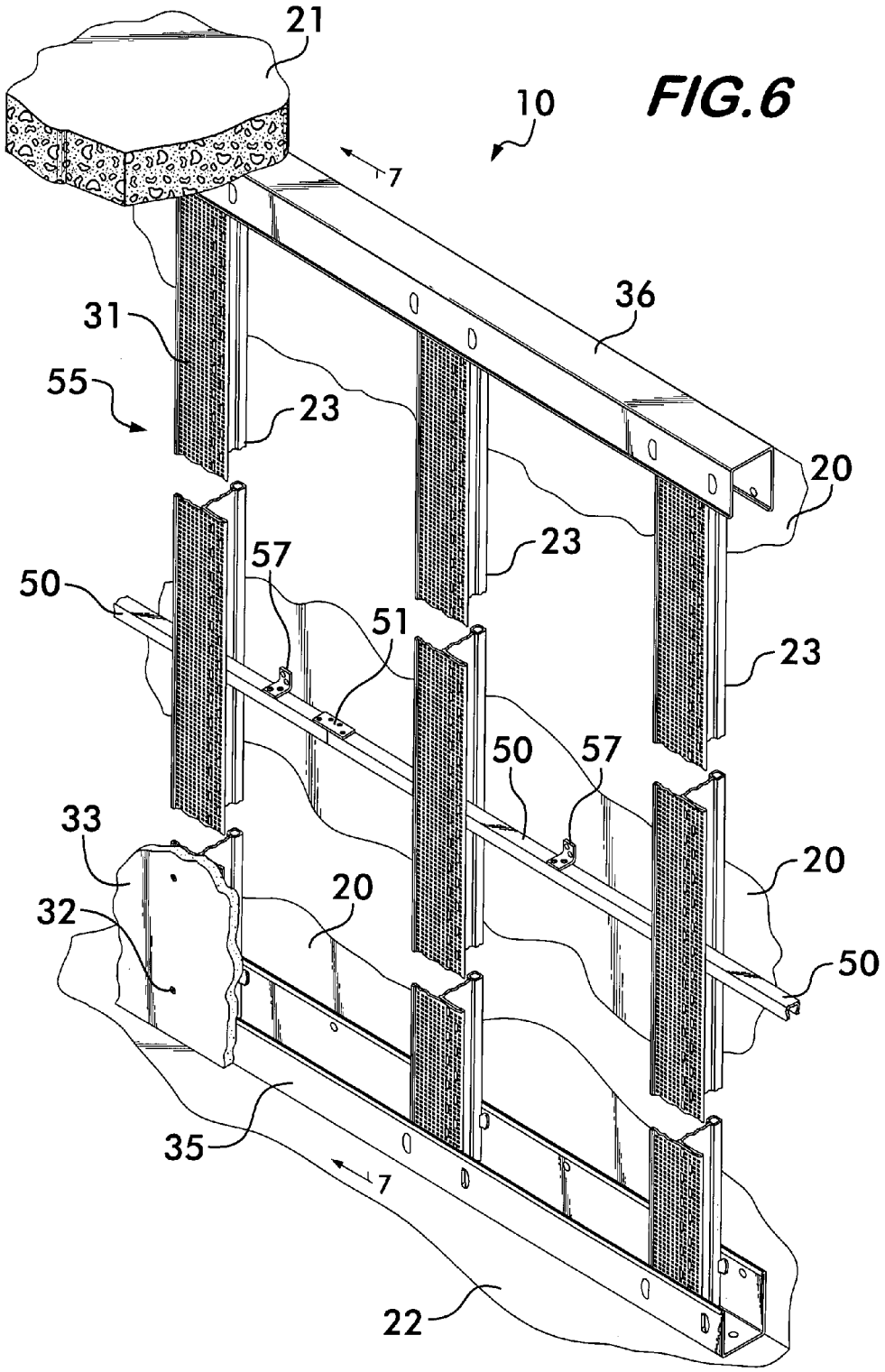
FIG. 6 is a perspective view similar to FIG. 1 showing an embodiment of the invention wherein the T-beams, acting as studs, are positioned against a structural wall.

The wall liner 10 of the invention is intended to stand in front of a vertical wall 20 between an upper ceiling 21 and a lower floor 22.

The wall 20, may be a structural wall, above or below ground level, of, for instance, poured concrete or concrete block, or wall 20 may be any other form of wall, such as a partition wall. In such instances, it is often desirable to form a liner of wallboard in front of the wall, for decorative or functional reasons.

A prior art wall liner generally has been built with U-shaped metal channels that act as studs, with the base of the U extending perpendicularly to the wall liner surface. Sheets of wallboard are attached to an arm of a channel by self-tapping screws. The channels stand vertically alone, and are stiff and rigid enough, by virtue of the U cross section which is formed of relatively thick metal, to withstand the forces imparted to the studs by the weight of the wallboard sheets, as well as forces from impact against the liner. The channels can also withstand the forces exerted when the screws are being attached.

In the present invention, prior art T-beams of the type disclosed in the '098 patent are used as vertical studs 23, notwithstanding the beams have been designed to extend horizontally and to primarily resist bending loads from the weight of a ceiling. Such prior art T-beams are formed by passing webs of sheet metal successively through rolling stations that fold the metal into a cross section having a bulb 25, a web 26 depending from the bulb 25, and a pair of flanges 27 extending oppositely from web 26.

The flanges 27 generally have indentations 31 that capture a self-tapping screw 32 which passes through wallboard 33 to hold the wallboard 33 to the stud 23, as disclosed in the '098 patent.

Figure 7:
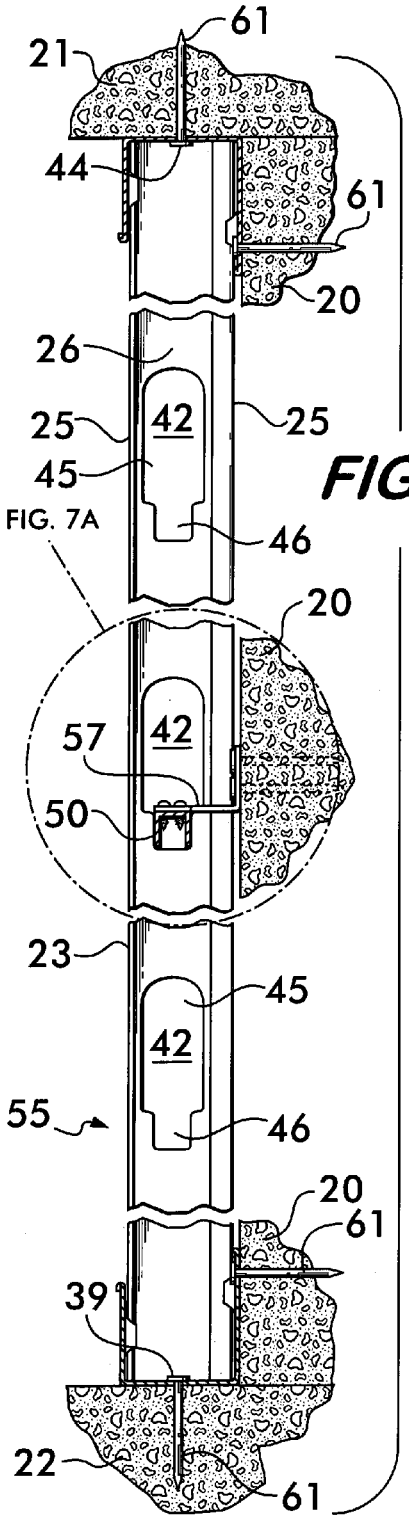
FIG. 7 is a view similar to FIG. 2, taken on the line 7-7 in FIG. 6, showing the T-beams, acting as studs, extending vertically along the structural wall.

The studs 23 are positioned close to the wall 20 as seen in FIG. 2, or against the wall 20, as seen in FIG. 7. The studs 23 are anchored at the bottom in bottom track 35, and the top in top track 36.

The tracks 35 and 36 are formed of a U-shaped channel having in cross section, a shorter arm 37 and a longer arm 38, and a base 40. The base 40 is nailed at 39 to the floor 22 and at 44 to the ceiling 21 along the wall 20, and the vertical studs 23 are locked into the tracks 35 and 36 by means of locking tabs 41 that are spaced, as seen particularly in FIG. 5, to capture the bulb 25 of stud 23 in arm 38, and the flanges 27 in arm 37. The tabs 41 are pierced from the arms 37 and 38, and have sloping sides that permit the stud 23 to be maneuvered and locked into place in the tracks 35 and 36.

The tabs 41 are placed along the tracks 35 and 36 to provide suitable spacing, for instance, 16 inches between the stud centers. The tabs 41 on the top 36 and bottom 35 tracks are in vertical registry with each other.

The studs 23 during insertion into the tracks 35 and 36, engage the sloping sides of the locking tabs 41 of the tracks 35 and 36 and flex the arms 37 and 38 of the tracks 35 and 36 outward to permit the studs 23 to be forced into place.

The studs 23 have openings 42 spaced vertically in the webs 26. The openings 42 have a larger upper portion 45, which is roughly rectangular, and a smaller bottom portion 46, which is U-shaped. Such openings 42 are of a similar shape to the prior art openings in prior art U-channel studs, that provide means for passing electrical wiring through such U-channel studs.

Figure 7A:
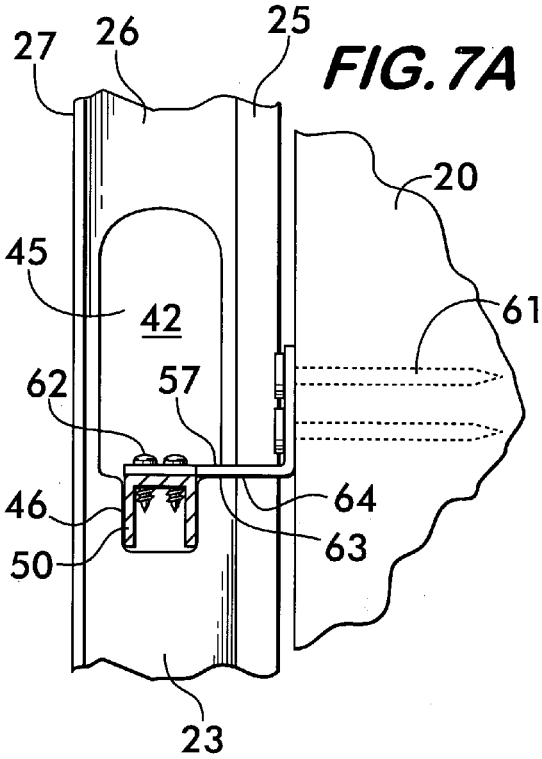
FIG. 7A is an enlarged view of the circled area in FIG. 7.

A strut 50 having a U-shaped cross section corresponding to the shape of the lower portion 46 of opening 42, that has been maneuvered through the larger opening 45, engages the lower section 46 in a force fit, as shown particularly in FIGS. 2, 7 and 7A. The struts 50 may be spliced together longitudinally with a splice plate 51, using pre-tapped holes in the strut 50 and plate 51.

The strut 50, which in the embodiment shown, has a cross section of an inverted U, unites each of the vertical studs 23, and the strut 50, into a rigid grid 55.

Grid 55 is anchored at the top and bottom in tracks 35 and 36, wherein any horizontal force exerted against the wall liner at an individual stud 23, is distributed among all the studs 23, and resisted by the strength of the combined studs 23. Angle shaped braces 57, spaced along strut 50 to stabilize the strut, are anchored into wall 20 with suitable fasteners, such as hardened nails 61, and are secured to strut 50 by screws 62. The braces 57 may have a relatively long arm 63, such as seen in FIG. 2, where the grid 55 is set away from the wall 20, or may have a shortened arm 64, as seen in FIGS. 7 and 7A, where the grid 55 is against the wall 20.

The wall liner 10 is completed by attaching the wallboard sheets 33 to the grid 55. The wallboard sheets 33 register with the studs 23 at the edges of a sheet.

The sheets 33 are secured to the studs 23, at the sheet 33 edges, as well as optimally within the sheet 33, with self-tapping screws 32, which enter indents 31, where they pierce and are screwed into the flange, as seen in the '098 patent.

The grid 55, anchored at the bottom and top in tracks 35, 36, and braced against wall 20 by braces 57, supports the wallboard sheets 33 of the wall liner 10, both against horizontal forces against the wall liner, and vertical forces created by the wallboard, and matter connected to the wallboard, such as decorative wall hangings.

The invention claimed is:

1. In a drywall liner for a vertical wall, a grid having a) T-beams, each having a web and flanges extending from the web, formed of sheet metal, extending vertically as studs in the grid, with the flanges facing away from the wall, and b) struts extending horizontally in the grid through openings in the webs of the T-beams, each of such openings having a first portion capable of permitting one of such struts to be maneuvered through such first portion in an opening in each of a number of the T-beams, and a second portion capable of receiving said one of such struts in a force fit to secure said one of such struts to a T-beam, so that a number of the T-beams are united by means of said one of such struts.

2. The grid of claim 1 wherein a number of said one of such struts are secured together longitudinally.

3. The grid of claim 1 wherein such struts have a U-shaped cross-section.

4. The grid of claim 1 wherein a plurality of said one of such struts are capable of being maneuvered successively through a plurality of said one of such openings, and then connected horizontally end-to-end.

5. The grid of claim 1 wherein such struts are braced from the vertical wall.

* * * * *